US008525510B2

(12) United States Patent
Finnestad et al.

(10) Patent No.: US 8,525,510 B2
(45) Date of Patent: Sep. 3, 2013

(54) RAILWAY POSITIONING SYSTEM

(75) Inventors: Askell Finnestad, Tananger (NO); Hakan Lind, Skärholmen (SE); Carsten Hasberg, Karlsruhe (DE); Stefan Hensel, Karlsruhe (DE); René Rütters, Weinheim (DE)

(73) Assignee: Bombardier Transportation GmbH, Berlin (DE)

( * ) Notice: Subject to any disclaimer, the term of this patent is extended or adjusted under 35 U.S.C. 154(b) by 550 days.

(21) Appl. No.: 12/741,374

(22) PCT Filed: Nov. 28, 2008

(86) PCT No.: PCT/EP2008/010286

§ 371 (c)(1),
(2), (4) Date: May 5, 2010

(87) PCT Pub. No.: WO2009/068323

PCT Pub. Date: Jun. 4, 2009

(65) Prior Publication Data

US 2010/0266005 A1 Oct. 21, 2010

(30) Foreign Application Priority Data

Nov. 28, 2007 (EP) ..... 07023053

(51) Int. Cl.
*G01R 25/00* (2006.01)

(52) U.S. Cl.
USPC ..... 324/76.78; 324/179; 324/160; 246/122 R; 340/10.41; 340/539.11

(58) Field of Classification Search
USPC ..... 324/160–180, 76.78; 246/122 R; 340/10.41, 539.11
See application file for complete search history.

(56) References Cited

U.S. PATENT DOCUMENTS

| | | | | |
|---|---|---|---|---|
| 4,791,424 | A | 12/1988 | Pore | |
| 5,294,081 | A | 3/1994 | Malon | |
| 5,825,177 | A * | 10/1998 | Finnestad et al. | 324/179 |
| 6,011,508 | A * | 1/2000 | Perreault et al. | 342/350 |
| 7,741,956 | B1 * | 6/2010 | Nysen | 340/10.41 |
| 2008/0142645 | A1 * | 6/2008 | Tomlinson et al. | 246/122 R |

FOREIGN PATENT DOCUMENTS

| | | | |
|---|---|---|---|
| DE | 2164312 | | 12/1971 |
| DE | 3200811 | A1 | 7/1983 |
| DE | 19731110 | A1 | 1/1999 |
| DE | 19944896 | A1 | 3/2001 |
| EP | 0496650 | A1 | 7/1992 |
| EP | 0593910 | A1 | 4/1994 |
| EP | 1813499 | A2 | 8/2007 |

(Continued)

*Primary Examiner* — Jermele M Hollington
*Assistant Examiner* — Son Le
(74) *Attorney, Agent, or Firm* — The Webb Law Firm

(57) ABSTRACT

A railway positioning system provides an on-board speed measurement device (6) inducing eddy currents in the wayside structure at two spots along the travelling direction, measuring the variations of the magnetic field emitted by the wayside structure and determining position and speed by correlating the 2 measured signals known from U.S. Pat. No. 5,825,177 and a wayside coded tag (1) providing a coding recognizable by the onboard speed measurement device (6). The coded tag (1) consists of a bar (4) with several slots (3) in which metal blocks (2) of different sizes are mounted. The block sizes and positions are selected to represent a coding according to Quadrature Amplitude Modulation.

4 Claims, 2 Drawing Sheets

Coded Tag

Coded Tag Phase Shift Sub-assembly

(56) References Cited

FOREIGN PATENT DOCUMENTS

| | | | |
|---|---|---|---|
| FR | 2673901 | A1 | 9/1992 |
| GB | 388761 | | 2/1933 |
| WO | 9712796 | A1 | 4/1997 |
| WO | 0166401 | A1 | 9/2001 |

* cited by examiner

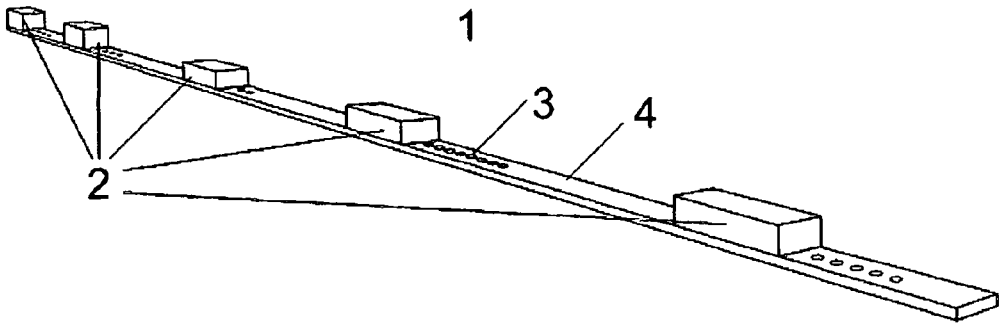
Figure 1: Coded Tag
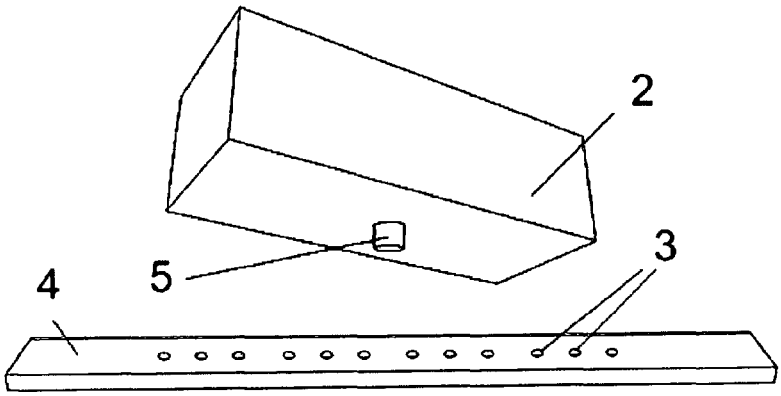
Figure 2: Coded Tag Phase Shift Sub-assembly
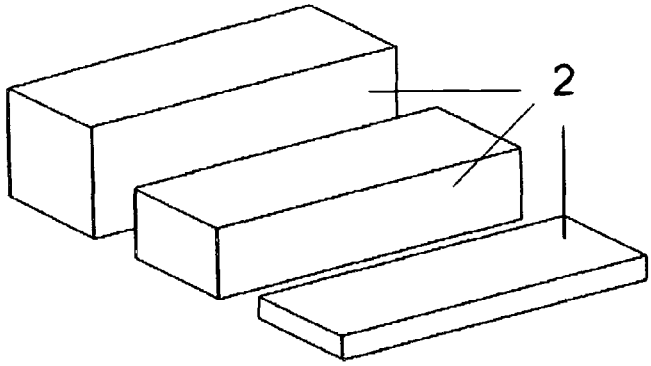
Figure 3: Coded Tag Amplitude Variation Sub-assembly

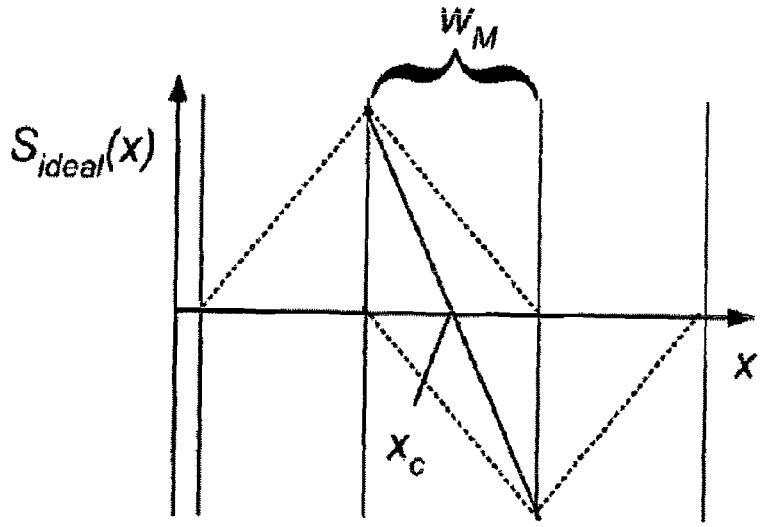
Figure 4: Ideal Sensor Signal
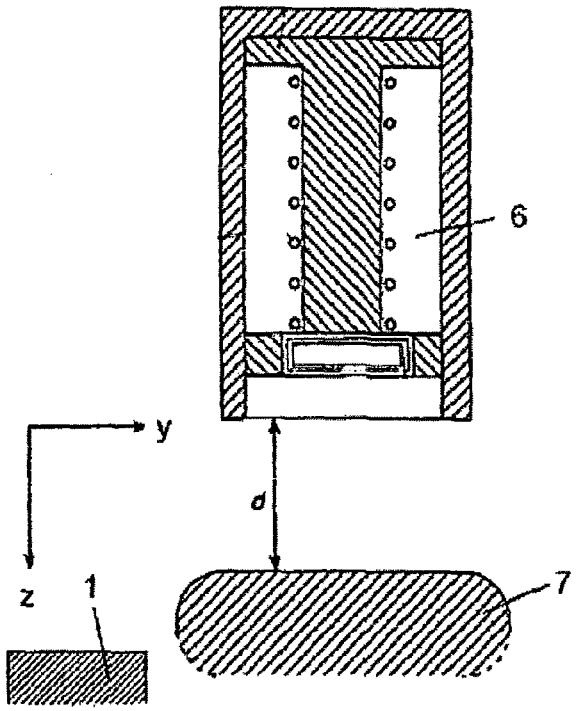
Figure 5: Cross-section of the Odometer, Railhead and Coded Tag
Prior Art

RAILWAY POSITIONING SYSTEM

BACKGROUND OF THE INVENTION

1. Field of the Invention

The invention relates to positioning systems for railways. Such devices measure the absolute and relative position and speed of railway vehicles and supply their measured values to driver displays, signalling, traction control systems and other users. In the railway context, absolute positioning refers to preset mile or kilometer positions on a track which is recorded in files and on wayside milestones. Relative positioning refers to a distance travelled since an earlier point in time.

2. Description of Related Art

Known solutions for relative positioning apply wheel rotation measurements, see e.g. GB388761, Radar, see e. g. U.S. Pat. No. 4,791,424 and induced magnetic fields measurements. Known solutions for absolute positioning apply wayside tags in the form of electronic transponders, see e. g. EP1813499 or track cable crossing locations, see e.g. EP0593910. The need to provide 2 separate systems for absolute and relative positioning drives cost and the amount of hardware to be installed. Satellite positioning combines absolute and relative positioning, see e. g. DE19731110 A1. However, data availability in tunnels and narrow valleys is low precluding its use as a universal solution. Magnetic speed measurement devices using pulsed coils to create magnetic markers in the rail are known from DE2164312 and FR-A-2673901. As shown in WO 01/66401 A1, absolute and relative positioning have been combined in one system using a speed measurement device measuring induced magnetic fields known from U.S. Pat. No. 5,825,177 which recognises patterns in the track like the rail gaps at points. This method only has limited coding opportunities and due to the similarity between points, dependability is not optimised.

SUMMARY OF THE INVENTION

One object of this invention is a cost and performance optimised absolute and relative positioning system.

The object is met by a positioning system with a coded tag for a railway magnetic speed measurement device, in particular as defined in the claims which define the scope of the invention.

The railway positioning system of the present invention comprises:

- an on-board speed measurement device,
- the device optionally inducing eddy currents in a wayside structure at two spots along the travelling direction,
- the device measuring the variations of the magnetic field emitted by the wayside structure and determining position and speed by correlating the two measured signals.

It is proposed that a coded wayside tag provides a coding recognisable by the on-board speed measurement device. In particular, the coding may be represented by an arrangement of electrically conducting blocks (e.g. metal blocks). E.g. the sizes and/or positions of the electrically conducting blocks at the tag correspond to the specific code. In this case, another expression for "coded tag" is arrangement of electrically conducting blocks with predefined sizes and/or positions of the electrically conducting blocks. Preferably, the tag can be modified to represent another coding, in particular by selecting another combination of electrically conducting block sizes and positions. Furthermore, tags having different arrangements of electrically conducting blocks can be located at different locations along the railway. The tag (e.g. at a bar) may comprise a plurality of mounting locations (e.g. slots) at predefined positions relative to each other where the electrically conducting blocks can be mounted to.

E.g. by using analogue outputs of the magnetic speed measurement device, magnetic patterns can be analysed in the same way as the point detection described above. By creating a known signature at a certain position, the position can be detected in a safe way.

The coding may represent telegrams which contain safety measures like cyclic redundancy checks if needed. The tag is simple and cheap. It can be mounted some centimeters aside of the rail and/or slightly below the rail head. Therefore, it doesn't interfere with ballast maintenance.

For example, use of Quadrature Amplitude Modulation provides good signal to noise ratio. A high information rate per tag length can achieved, in particular if one information unit represents a 4-bit-digital word.

The telegrams could be linked to other tags, e.g. they could announce the next tag and the distance to it. In this way, sections where the speed measurement device is not available can be bridged.

If the telegrams are changed by a control device, information depending on the dynamic state of other systems can be transmitted to the speed measurement device, e.g. signal aspects. A safety telegram format can be used for coding with the basic same performance of availability and wrong side failure rate as for a state-of-the-art tag system.

The coding can also be able to detect in which direction the vehicle is entering the tag. If the telegram is read by two autonomous sensors of the speed measurement device and if the result shall be the same, the number of Cyclic Redundancy Check bits will be relatively low.

For example, a 15 to 16 bit safety telegram will give a range of 500 to 700 unique telegrams with a reasonable distribution of 0 and 1 bits. The received signal is varying over time and the bit rate is depending on the speed of the vehicle. By using the actual speed and the correlation between the 2 speed measurement device channels, a transformation of the time varying signal to a spatial distribution can be achieved and the telegram can be read.

A bar may be fastened on the rail foot or on sleepers. Alternatively, the coding can be created by standard size metal blocks representing 1 and gaps representing 0.

BRIEF DESCRIPTION OF THE DRAWINGS

Examples of the invention will be described with reference to the attached drawings. Therein, interpretations and more detailed information concerning the expressions used above are given.

FIG. 1 shows a preferred embodiment of the coded tag 1 with metal blocks 2 of different sizes each attached to one of several slots 3 in a bar 4.

FIG. 2 shows a metal block 2 with a bolt 5 for the block's fixation in one of the slots 3 of the bar 4 shown below.

FIG. 3 shows three blocks 2 of different sizes representing the QAM amplitude modulation.

FIG. 4 shows the ideal signal $s_{ideal}(x)$ an on-board magnet sensor generates when passing a metal block 2 with its front and rear sensor in travelling direction x. The combined signal is represented by the solid line. The signal of each of the sensors is represented by dotted lines. Along the section $w_M$, both sensors received feed back from the block 2.

FIG. 5 shows the cross-section of a speed measurement device 6 according to U.S. Pat. No. 5,825,177, a rail head 7 and the coded tag 1.

DETAILED DESCRIPTION OF THE PREFERRED EMBODIMENTS

As shown in FIG. 1, the coded tag 1 comprises a bar 4 with several slots 3 in which metal blocks 2 of different sizes are mounted. The block sizes and positions are selected to represent a coding according to Quadrature Amplitude Modulation QAM which as known in the art maps 4-bit digital words to vectors of length or amplitude A and angle ϕ. Expressed as complex number this is $$s(t)=A(t)\cdot e^{i[2\pi f_c t+\phi(t)]}$$

As shown in U.S. Pat. No. 5,825,177, the magnet speed measurement device can sense the amplitude and position along the travelling direction of signals generated by the wayside structure. The coded tag 1 exploits this by providing metal blocks 2 of different sizes as shown in FIG. 3 feeding back a signal to the speed measurement device 6 about proportional to the block size. The blocks 2 are mounted at selected locations along the travelling direction by fixing them with their bolts 5 in selected slots 3 of the bar 4 as shown if FIG. 2. When the railway vehicle travels along a coded tag 1, it senses the first blocks 2 which are arranged in a sequence representing a start indication. In parallel to reading the coded tag 1, the speed measurement device 6 provides the current speed information. The vehicle then senses feed back signals with amplitudes proportional to the block sizes as shown in FIG. 4 where the signal of each of the speed measurements device's sensor is a dotted line and the combined signal is a solid line. The signals of the sensors have opposing signs so that equal amplitudes compensate. At constant speed, the time intervals when the feed back signals are registered are proportional to the positions where the blocks 2 are mounted at the bar 4. If the speed is not constant, the corresponding recalculation has to be effectuated. As shown in FIG. 5, the coded tag 1 is mounted laterally to the rail head 7 at a height not interfering with the wheels of the vehicles.

An embodiment of the invention may be summarised by the following:

A railway positioning system provides an on-board speed measurement device (6) inducing eddy currents in the wayside structure at two spots along the travelling direction, measuring the variations of the magnetic field emitted by the wayside structure and determining position and speed by correlating the 2 measured signals known from U.S. Pat. No. 5,825,177 and a wayside coded tag (1) providing a coding recognisable by the on-board speed measurement device (6). The coded tag (1) consists of a bar (4) with several slots (3) or holes in which protruding pins of metal blocks (2) of different sizes are mounted. The block sizes and positions are selected to represent a coding detectable according to Quadrature Amplitude Modulation.

The invention claimed is:

1. A railway positioning system comprising:

an on-board speed measurement device which induces eddy currents in a wayside structure at two spots along a travelling direction, measures variations of a magnetic field emitted by the wayside structure, and determines position and speed by correlating the two measured signals, and a wayside coded tag providing a coding recognisable by the on-board speed measurement device, with the coded tag comprising electrically conducting blocks of different sizes representing an amplitude of a Quadrature Amplitude Modulation, wherein the blocks are mounted at the coded tag parallel to the railway vehicle's travelling direction at positions representing the Quadrature Amplitude Modulation's phase shift.

2. The railway positioning system according to claim 1, wherein the coding contains link information between several coded tags.

3. A wayside coded tag for coding recognisable by an on-board speed measurement device of a rail vehicle, the coded tag comprising electrically conducting blocks of different sizes representing an amplitude of a Quadrature Amplitude Modulation, wherein the blocks are mounted at the coded tag parallel to the railway vehicle's travelling direction at positions representing the Quadrature Amplitude Modulation's phase shift.

4. A method of determining position and speed of a rail vehicle using an on-board speed measurement device, said method comprising the steps of inducing eddy currents in a wayside structure at two spots along a travelling direction, measuring variations of a magnetic field emitted by the wayside structure, and determining position and speed by correlating the two measured signals, wherein a wayside coded tag is arranged in such a manner that it represents a coding recognisable by the on-board speed measurement device, and wherein the coding is achieved by mounting-electrically conducting blocks of different sizes representing an amplitude of a Quadrature Amplitude Modulation, and mounting the blocks parallel to the railway vehicle's travelling direction at positions representing the Quadrature Amplitude Modulation's phase shift.

* * * * *